US006106649A

United States Patent [19]

Slyne

[11] Patent Number: 6,106,649

[45] Date of Patent: Aug. 22, 2000

[54] CONTINUOUS METHOD OF MAKING A THREE DIMENSIONAL SAIL

[75] Inventor: William J. Slyne, Toronto, Canada

[73] Assignee: North Sails Group, Inc., Milford, Conn.

[21] Appl. No.: 09/166,007

[22] Filed: Oct. 2, 1998

[51] Int. Cl.[7] ..... B32B 31/00

[52] U.S. Cl. ..... 156/179; 156/177; 156/178; 156/439; 156/440; 156/199; 114/103

[58] Field of Search ..... 156/177, 179, 156/440, 439, 166, 245, 242, 199; 114/103

[56] References Cited

U.S. PATENT DOCUMENTS 4,080,232 3/1978 Friedrich ..... 156/177
5,097,784 3/1992 Baudet ..... 114/103
5,355,820 10/1994 Conrad et al. ..... 114/103

FOREIGN PATENT DOCUMENTS 56657 7/1982 European Pat. Off. .
WO87/07233 12/1987 WIPO .

*Primary Examiner*—Jeff H. Aftergut
*Attorney, Agent, or Firm*—Pyle & Piontek

[57] ABSTRACT

A three dimensional sail of one piece construction is made on a rotating roll having a deformable outer surface. The roll is divided into a large number of segments, extending across the width of the roll, with the convex profile of each segment being adjustable. A sail is made on the roll on a continuous basis by applying a first layer of film, deforming the film on the roll, applying adhesive and reinforcing the yarns, and applying a second layer of film to form a 3-D laminate.

13 Claims, 7 Drawing Sheets

CONTINUOUS METHOD OF MAKING A THREE DIMENSIONAL SAIL

BACKGROUND OF THE INVENTION

This invention relates to a method for the continuous production of sails for sailing vessels and more particularly to the production of laminated molded sails.

Conventional modern sails for sailing vessels are not flat but have a three dimensional foil shape. Most sails up to the present time have been made from flat panels of woven cloth, cloth and film laminates, or film laminates reinforced with yarns or scrim. The flat panels are first cut into a predetermined shape, and the panels are joined together along adjacent edges. In a process called broadseaming, one or both of the adjacent edges of the panels may be curved, such that the subsequent seaming results in an approximate three dimensional shape.

The construction of a sail on a static mold is well known and is described in Wagner EP patent 056,657 and in Gardiner U.S. Pat. No. 2,565,219 and Baudet U.S. Pat. No. 5,097,784.

The Baudet patent discloses a one piece three dimensional sail which is seamless and paneless. The sail is constructed on a convex mold having a three dimensional shape, with the shape of the mold being adjustable to the desired shape of the sail. A first layer of film is placed on the mold, reinforcing yarns are applied with an overhead gantry together with adhesive, and a final layer of film is applied. The laminate is then heated under pressure to bond the adhesives and to cause the laminate to permanently assume the shape of the mold. Sails of this nature are currently being marketed by North Sails under the trademark "3DL" and have achieved substantial commercial success.

While the sail described in U.S. Pat. No. 5,097,784 has superior qualities in comparison to conventional sails made from seamed individual panels, the process for making the sail is labor intensive and time consuming. The mold must be large enough to accommodate a variety of sizes of sails, and only a single sail can be produced on the mold at one time. Also, the mold itself is a complicated and expensive structure, and the process have many variables which require careful control.

SUMMARY OF THE INVENTION

In accordance with the present invention, a three dimensional sail of one piece construction is made on a slowly rotating roll having a deformable outer surface. The roll is divided into a plurality of segments, extending across the width of the roll, with the profile of each segment being separately and individually adjustable to a convexly curved shape corresponding in proportion to the front to back profile of the sail in successive segments of the sail. The profile of the segments may be adjusted by lines of adjustable pistons extending radially outwardly from the central portion of the roll. The lines of pistons are connected to linear flexible members forming a support surface on the roll.

A continuous strip or strips of polymeric film are unwound from a roll or rolls and are applied onto an undeformed cylindrical portion of the roll to provide a lower continuous film layer. As the roll rotates, successive sectors of the film are heated while curvature is imparted to the sector, with normally different degrees of profile curvature being imparted to successive sectors, causing permanent deformation of the film. The profile of each sector of the roll is maintained as the roll is rotating, with the supported film passing through an adhesive applicator and yarn applicator zones. In this latter zone, moving yarn applicators located above the roll apply adhesively coated reinforcing yarns to the film in a programmed manner. These applicators are capable of laying down yarns across the roll and along the length of the film and at angles thereto.

A second forming roll is provided to heat and deform a second film layer to coincide with the lower or base film layer. The second or upper film layer, deformed in three dimensions and matching the shape of the first layer, is applied to base film and encapsulates the reinforcing yarn network. In the alternative, the second layer of film is deposited directly from supply rolls onto the primary roll for shaping. Following this step, the assembled laminate is subjected to heat and compression while supported on the profiled roll. The step of compression may comprise the steps of piercing the base film layer before the second layer of film is applied, followed by application of the second film and the application of vacuum or suction through the perforations to draw the two film layers together. Preferably, the film is pierced prior to application of the drum. The laminate is heated by a flow of hot air, causing the adhesive to flow and seal the layers.

The resulting three dimensional laminate is cooled and removed from the forming cylinder, and the profile of successive roll sectors is returned to undeformed or cylindrical shape to receive fresh flat base film.

The length of a sail being produced is not limited to the circumference of the roll, since the profile of the sectors can be adjusted to a wide degree. Thus, the process enables the production of sails in a continuous and uninterrupted fashion, limited only by the continuous supply of raw film and yarn. In comparison to methods using static molds, substantial savings of time and labor are realized. The design, weight per unit area, size and shape of the sail are incorporated into a computer program which automates the sectors of roll profile adjustment and layout and density of reinforcing yarns. Thus, except for possible trimming and finishing operations, the procedure is continuous and automatic.

DESCRIPTION OF THE PREFERRED EMBODIMENTS

Figure 1:
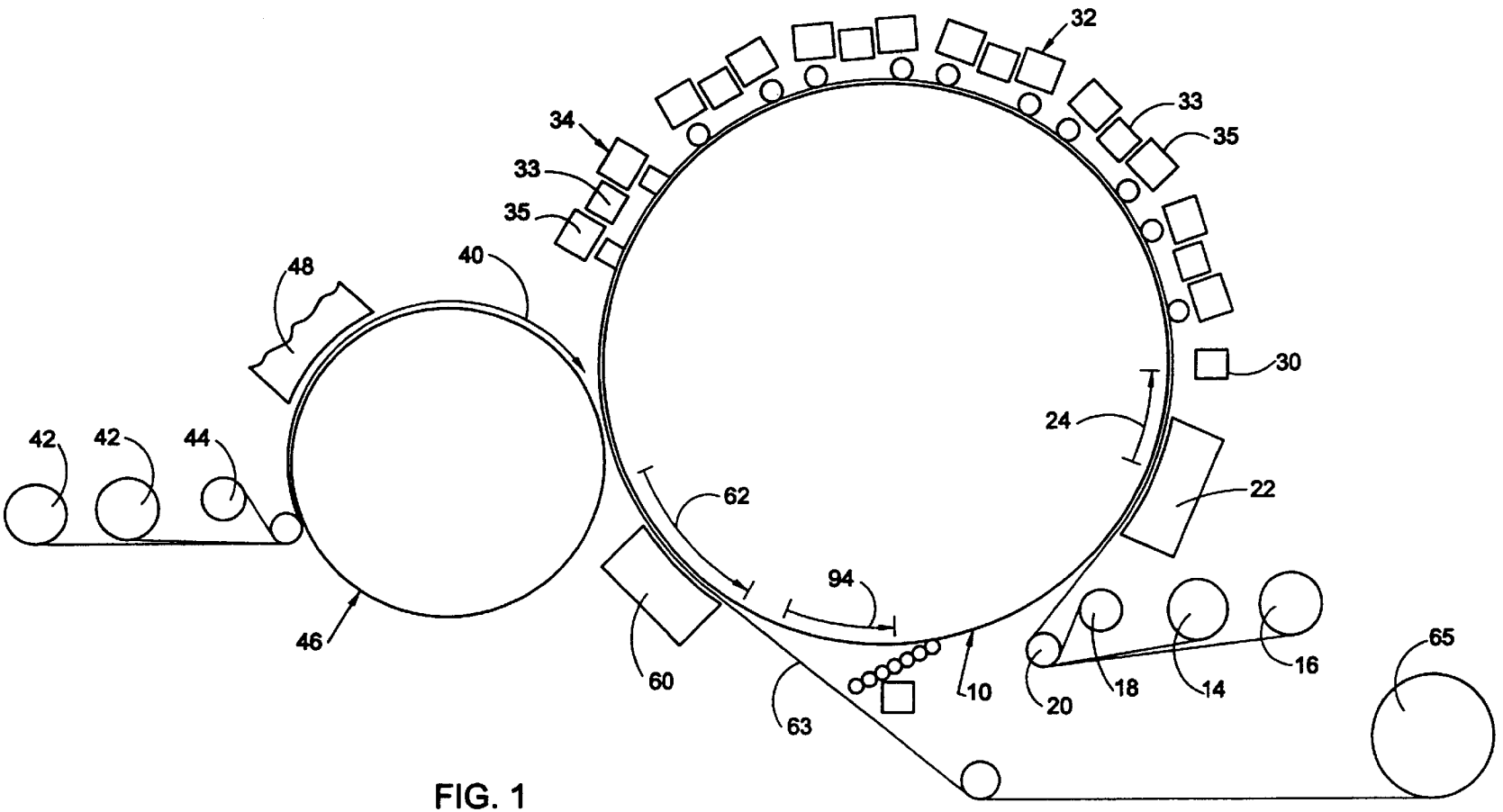

The method of the present invention will first be generally described in connection with FIGS. 1 through 4. The method will be described in connection with a completed sail 50 shown in FIG. 5. The completed sail will be typically triangular in shape and will comprise a head 51, or top corner, a tack 52, or forward lower corner, and a clew 53. The three edges of a sail are defined as the luff 54, or leading edge, the leech 55 or trailing edge, and the foot 56 or bottom edge. The finished sail is a laminate comprising two outer film layers 57 and an inner network of reinforming yarns. Yarns 58 generally extend from the top to the bottom of the sail and include yarns converging into the corners. Yarns 59 generally extend across the sail and between the bottom two corners.

Figure 2:
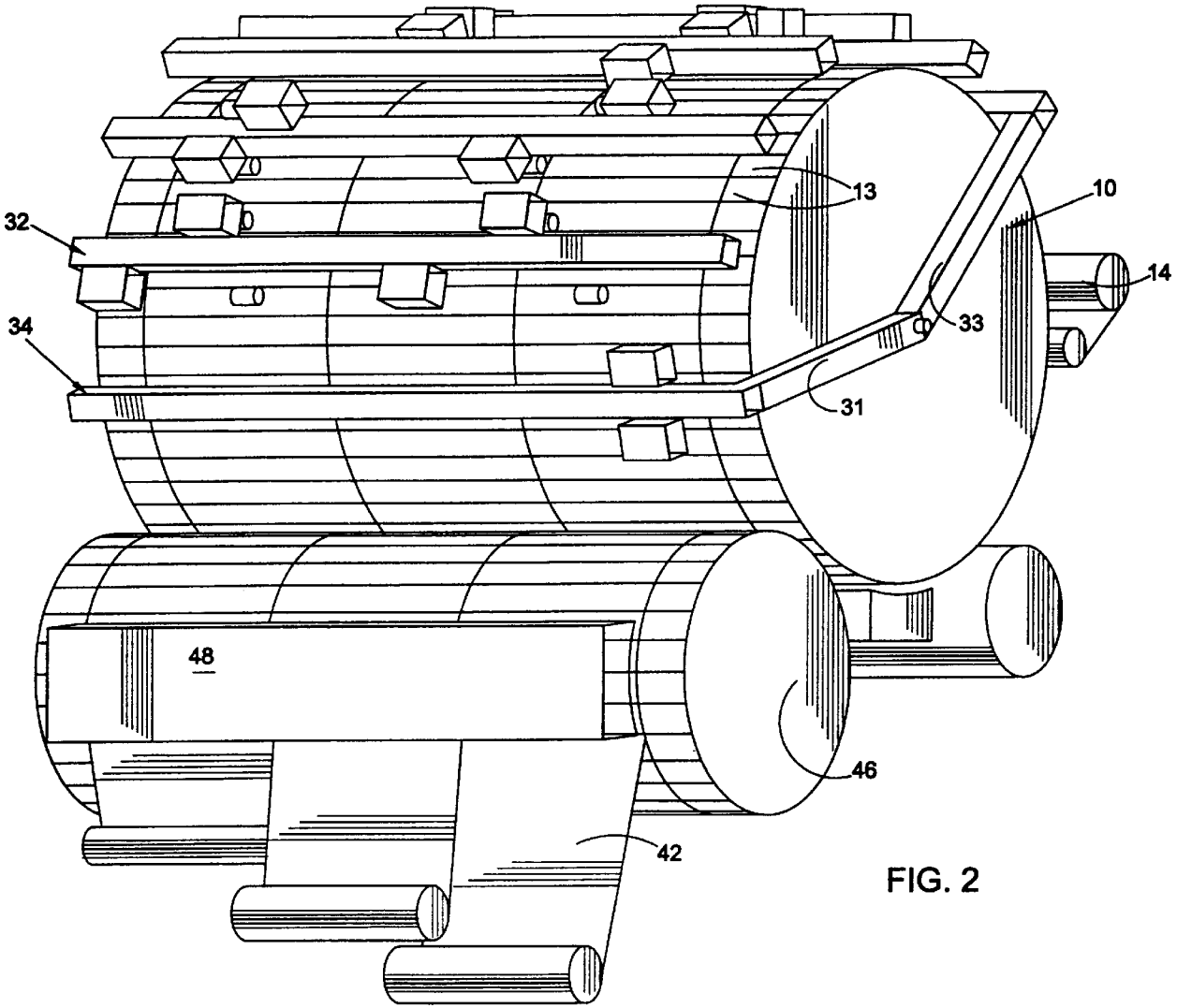

As shown in FIGS. 1–4, the sail is fabricated on a roll 10 rotating in a counterclockwise direction as shown in FIGS. 1 and 2. A base layer of perforated film 12 is applied to the roll across the width thereof. The film 12 may be precoated with adhesive, the tape may be eliminated, and adjacent edges of the film may be overlapped. The film may be strips unwound from staggered rolls 14 and 16 and joined together along facing or overlapping edges with adhesive tape supplied from roll 18, with the joined strips being guided by guide roll 20 under uniform tension. During processing, the base film layer 12 is held onto the roll surface by application of a partial vacuum through the cylindrical wall of roll, as described hereinafter.

The roll has a flexible deformable surface in which adjacent surface segments 13 (FIG. 2) across the roll, i.e., parallel to the axis of rotation, may be deformed into successive convexly curved profiles. The base film layer 12 is first heated by a hot air or radiant heater 22 adjacent the roll to soften the film. In the zone denoted by the arrow at 24, the roll segment supporting the heated film is deformed to cause the film to be deformed along a narrow contiguous segments across the roll.

Figure 3:
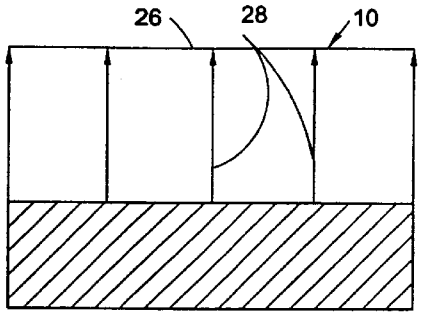
Figure 4:
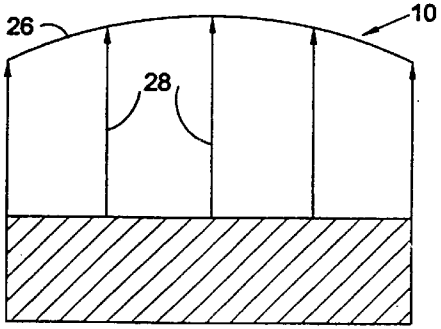

FIGS. 3 and 4 schematically show a roll 10 having an outer flexible surface 26, with the surface profile being adjusted by means of pistons 28. FIG. 3 shows the pistons in a neutral position in which the outer surface segment is cylindrical. FIG. 4 shows adjustment of the pistons such that the surface 26 is curved to an airfoil shape. As shown in FIG. 4, and with reference to FIG. 5, the luff 54 or leading edge portion of the base film of the sail would be located on the left side of the drawing and the leech 55 or trailing edge of the sail is located at or near the right edge. Since the film is being deformed along a curved profile in the cross direction and is wrapped around the cylinder in the longitudinal or machine direction, the film is being deformed, in a successively varying manner, in three dimensions. In other words, the curvature of the roll around its circumference and the curved profile of the sectors both contribute to the permanent deformation of the film, such that the Gaussian curvature of the original sail designed is preserved all points on the surface.

When the roll reaches the end of arrow 24, the pistons 28 are locked to maintain the profile of the film sector until all subsequent processing steps are completed. Since the curvature or draft of a sail varies from the head or top to the foot or bottom, the cross curvature of successive profile curvatures change.

The shape and dimensions of sails are determined from standard models, and all necessary information can be stored in the form of data in a computer. This information can be converted into signals which cause individual adjustment of each of the pistons 28 in each successive line. Using a foresail or jib as an example, the draft or rate of curvature will be greater near the luff 54 and the density or number of the pistons 28 may be greater in this region, as shown in FIGS. 4 and 4*a*.

Figure 4A:
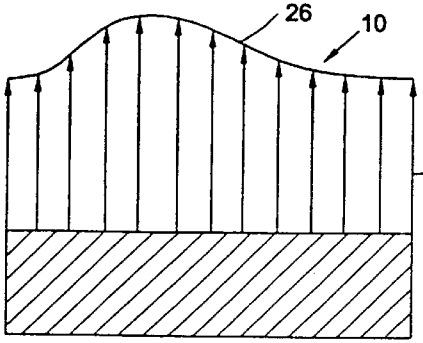

FIG. 4*a* illustrates the principle of employing only a portion of the width of the roll to make sails having smaller widths. In such case, the roll would be deformed on the left hand side, with the right hand side remaining undeformed.

Following heating and deformation, the film is coated with adhesive, such as by a spray head 30 applying adhesive in liquid form and transversing back and forth across the film surface, while moving with the surface to obtain a pass parallel to the axis of the cylinder. In the preferred embodiment, the film is pre-coated with an adhesive. The adhesive is preferably of the thermoplastic or hot melt type.

The moving adhesive coated film then passes under a plurality of stations 32 and 34 for applying reinforcing yarn to the film. The stations 32 are spaced to assure adequate coverage of the yarns to the film. The stations comprise fixed transverse support beams 33 having automated yarn dispensers 35 movably mounted thereon wherein the yarn is guided and applied to the film by rollers 37. The dispensers 32 move back and forth across the moving film and apply yarns 58 which will extend from the top 51 to the bottom 56 of the sail (FIG. 5) or at acute angles thereto. Since all modem sails are triangular, the stations 32 will apply yarns extending continuously diverging from the top corner or head 51 into the body of the sail and converging into the two lower corners or the tack 52 and clew 53. Preferably, the yarn is precoated with adhesive.

The station 34 serves to apply yarns 59 across the width of the film, such as between the tack 52 and the clew 53, and across the other yarns 58 between the edges of the sail. All yarns 58 and 59 are preferably applied in a continuous and uninterrupted fashion, from corner to corner, from corner to edge, or from edge to edge. As shown in FIG. 2, the station 34 and the adhesive applicator 30 may be mounted on motorized radial arms 31 and 33 to allow movement of the applicators in the direction of movement of the film.

After a sufficient number of yarns have been applied in the desired pattern to complete a single sail, the yarns may be fed continuously from the applicators to an adjacent area of the film to define the next sail. In the alternative, the yarns may be severed and repositioned by the applicators for the start of a new sail.

The yarns may be composed of any of the known type used in modern sailmaking. These typically include twisted and untwisted continuous filament yarns composed of polymers such as polyester, aramid, oriented polyethylene and the like, as well as individual monofilament threads. The denier of the yarns can be adjusted to suit the particular weight or type of sail being produced, and the number or density of yarns may be programmed to provide the desired weight. In addition, as described in the Baudet U.S. Pat. No. 5,097,784, the yarns are preferably applied in a calculated pattern to best accommodate the major stress lines in the sail when the sail is in use, such that the yarns will generally radiate from the corners. Other yarns may intersect with the primary yarns to provide support at various sailing angles and to resist tear.

The composition of the film may be any of those available and employed in modern sail laminates. Typically, stretch resistant films of polyester are employed, but others are known and may be used.

Following the application of the yarns, a second layer of film 40 is applied to the first layer, which now carries the yarn and the adhesive on its exposed surface. The second film layer 40 is not perforated and may be supplied in the form of strips from rolls 42 joined together by adhesive tape 44, or if precoated, by edge overlap. The film 40 may be formed on a second separate smaller deformable roll 46 having a heater 48. The roll 46 also has a continuously adjusting profiled surface such that the film 40 is deformed to match the perforated base film 12 on roll 10. In the preferred embodiment, the film is not performed but can be fed, in flat form, directly to the primary roll over an idler roll similar to roll 20 upstream of the heater 60. Thus, the second layer of film will be deformed solely by the preliminary roll 10. The film 40 is fed onto roll 10 to form a layered structure, and such structure is passed beneath and heated by a heater 60. In the roll position indicated by the arrow 62, a high degree of vacuum is applied. The vacuum is drawn through the perforated base film 12, causing the two film layers to be drawn together while being heated to set the adhesive, thereby forming a permanent laminate.

Figure 5:
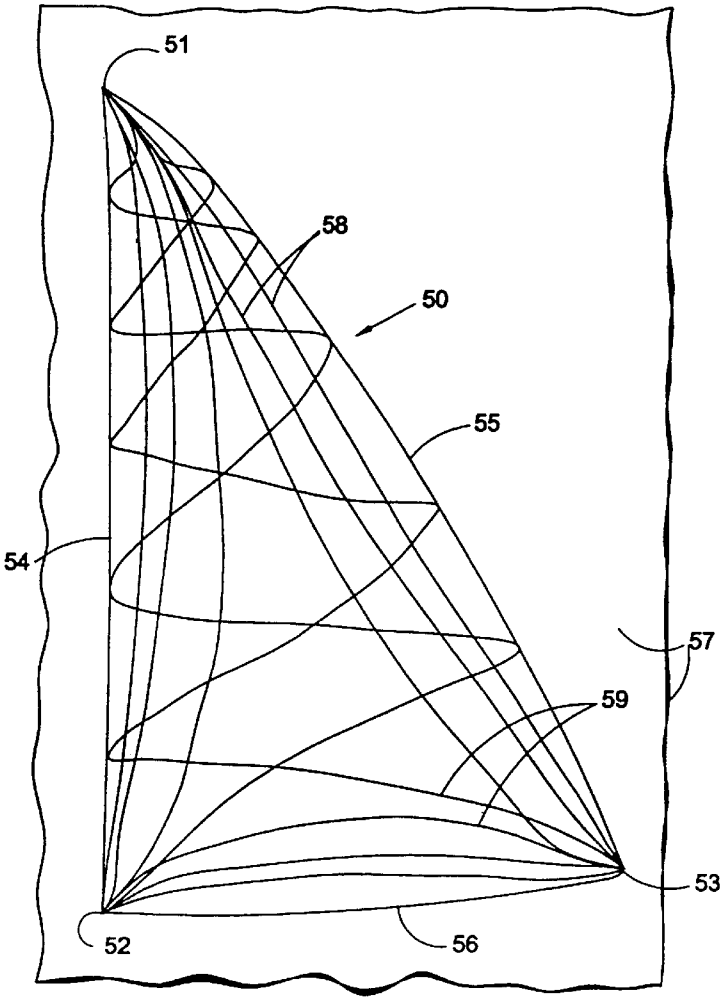

The completed laminate 63 is then led off the forming roll and may be wound up on a take-up roll 65. The sail may be finished by cutting out of the sail from the sheet and performing any finishing operations. The resulting sail, as shown in FIG. 5, is a unitary, seamless and paneless structure.

Figure 6:
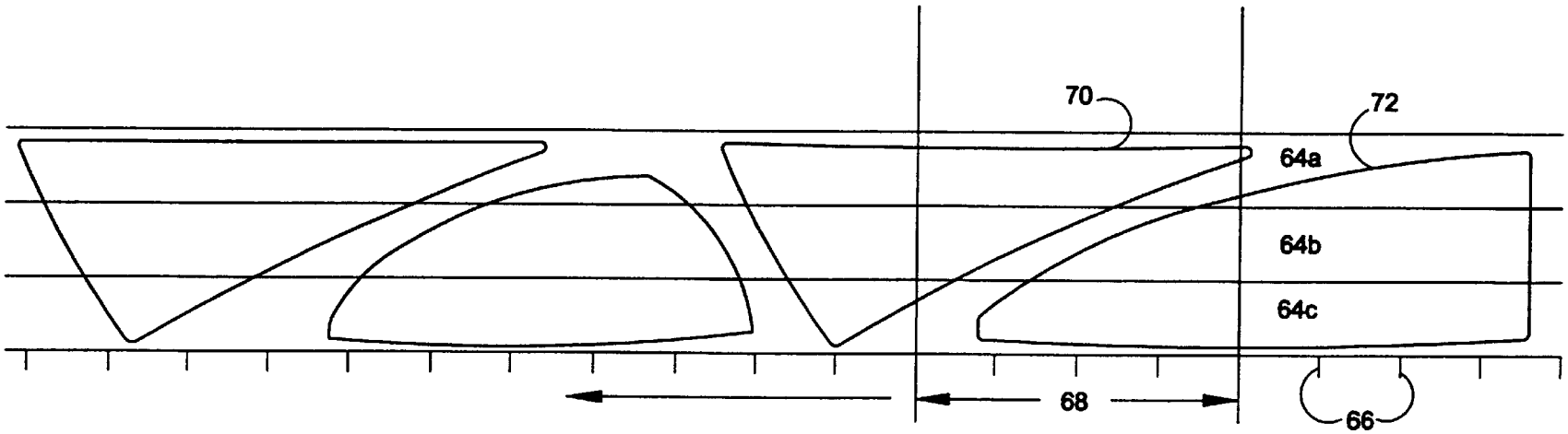

The apparatus of the present invention may be employed to make single successive sails on a continuous basis, as well as sails having portions which overlap within the base film layer. The latter is illustrated in FIG. 6 in which three butted film layers or strips 64*a*, 64*b* and 64*c* are employed. The dimension 66 is equal to one meter, and the dimension 68 is equal to one wrap of film on the roll. It may be seen that portions of successive sails such as outlined at 70 and 72 may overlap, such that portions of two sails are being produced at the same time. The size of the sail is limited to the maximum width of the roll and the film, which in most cases is measured across the foot.

Figure 7:
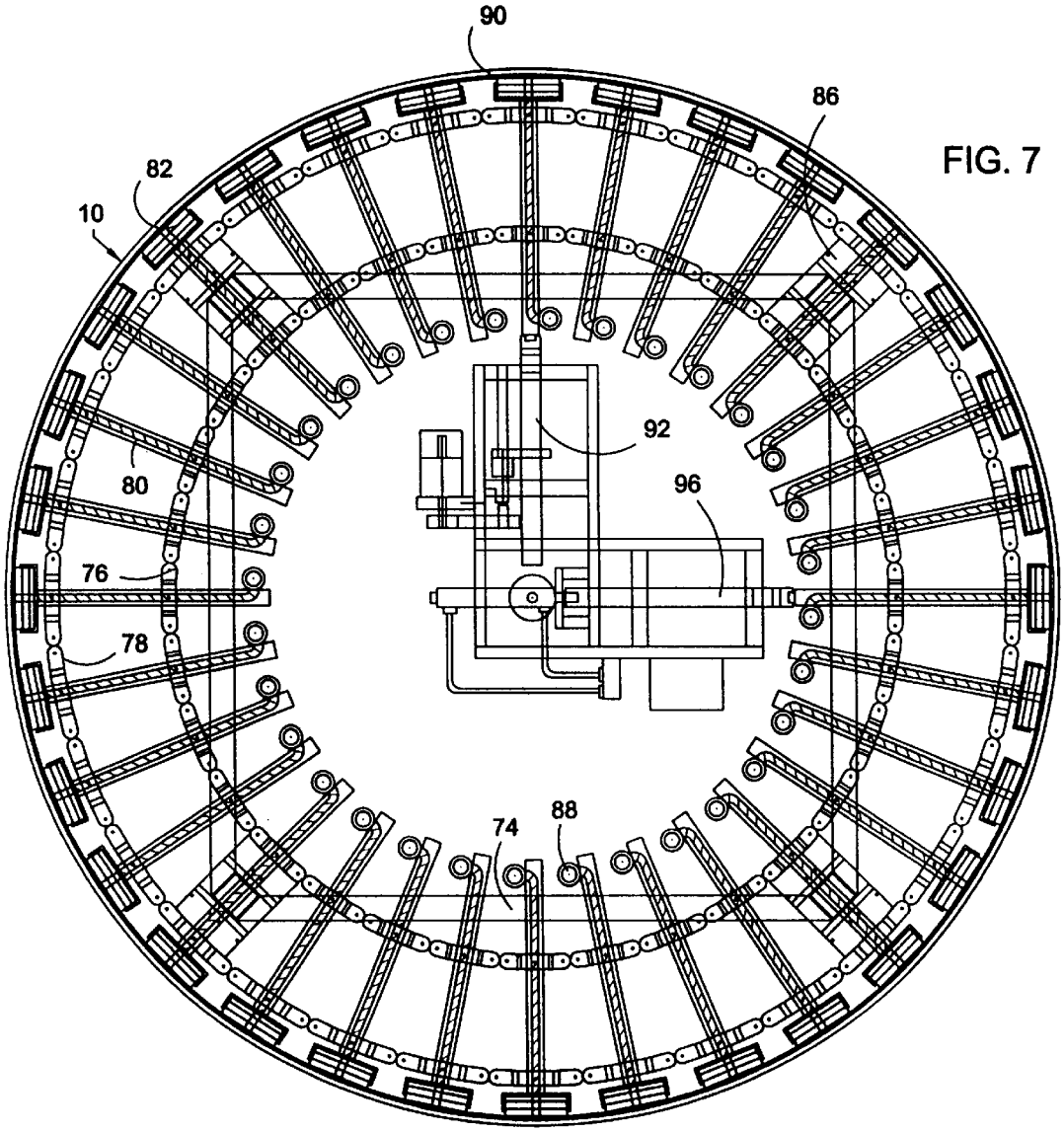
Figure 8:
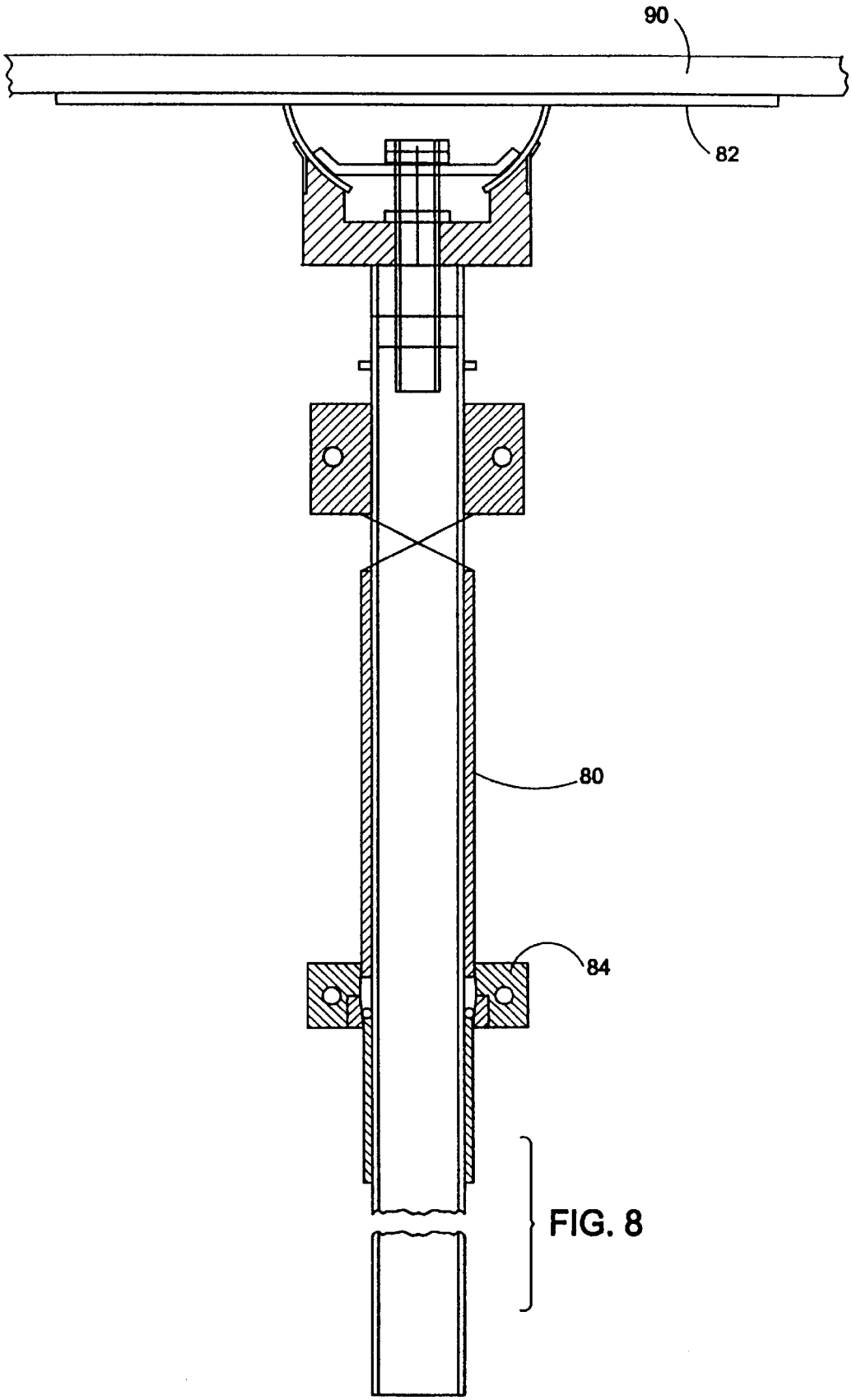

FIG. 7 shows the roll in cross section, and FIG. 8 shows a cross section of a piston and roll cover assembly. The roll 10 is mounted on a support frame 74 having inner and outer supports 76 and 78 for the pistons 80. The outer end of the piston 80 is connected to a flexible batten 82 extending across the width of the roll. The pistons include a locking device 84 (FIG. 8) for locking the piston in an advanced position, and the piston rods are advanced in sequence by an actuator 86. The piston rods are hollow and are connected to vacuum lines 88 leading through a flexible surface 90 covering the battens 82. If desired, separate vacuum lines to the surface may be used. The flexible surface may comprise a layer of textured elastomer having vacuum openings, which layer is covered by a permeable fabric to distribute the vacuum evenly over the surface.

As shown, a retractable, pneumatic or screw driven actuator 92 engages the rod of the piston 80 and rotates therewith as the piston is moved radially outwardly to the desired position. The lock 84 locks the piston in its extended position, and a second actuator 96 is provided to unlock the piston at the end of the drum rotation cycle and to return the piston to its initial position. The pistons are returned to neutral position in the arc 94 (FIG. 1) after the laminate has been moved from the roll.

Figure 9:
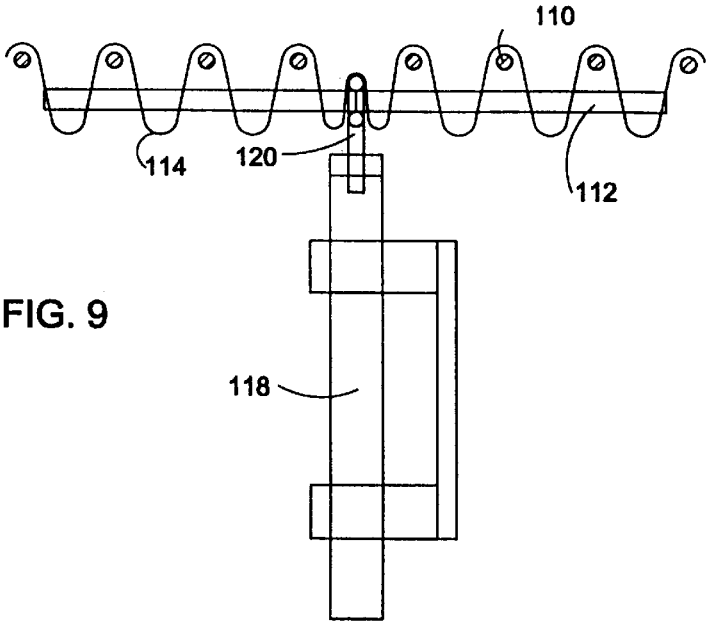
Figure 10:
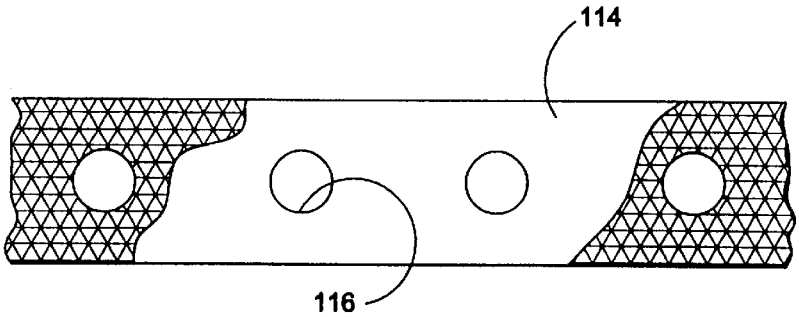
Figure 11:
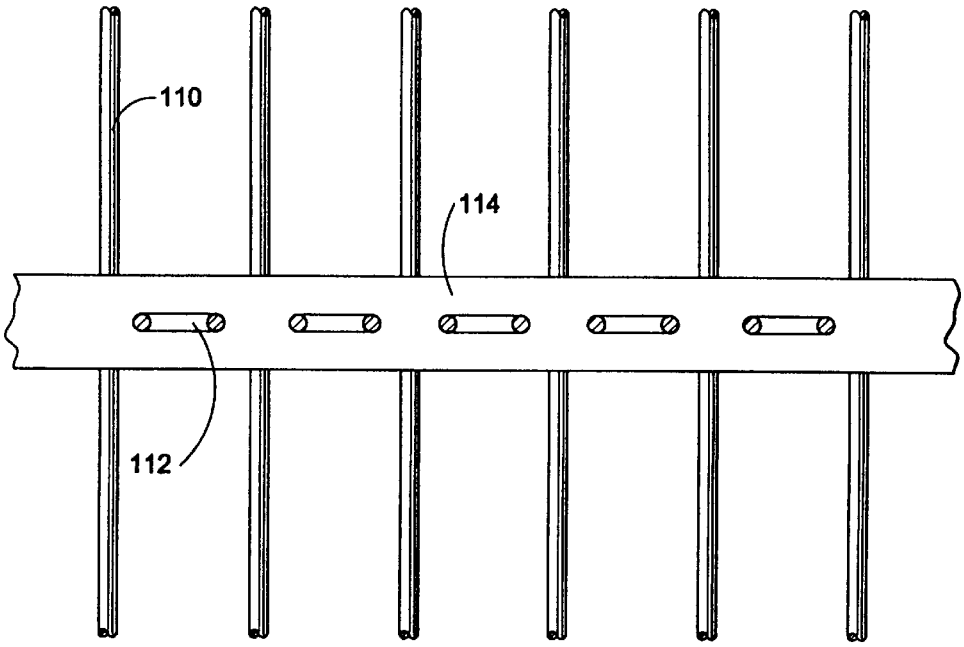

FIGS. 9–11 illustrate an alternative and preferred arrangement for providing a deformable framework for the outer surface of the forming and support cylinder 10. A first plurality of flexible roll 110 are formed into parallel circles with telescoping ends, to define the roll circumference support portion. A second plurality of flexible rods 112 are disposed at right angles to and above the first plurality 110 and extend parallel to the axis of the roll 10. The rods 110 and 112 are flexibly tied together, for example, by a flexible strip 114 having a plurality of spaced apertures 116 therein arranged along a line. The apertures 116 pass through the rods 112 at spaced locations and are looped upwardly around the circumferential rods 110 to hold the assembly together in a flexible manner. The assembly is covered by one or more elastic sheets as previously discussed to provide a forming surface. The circumferential rods are connected to pistons 118 by eyebolts 120 to selectively radially expand and restrain the assembly in a radial direction.

In practice, as a practical example, the main roll will have a diameter of 120 inches and will have a width of greater than 180 inches, in order to accommodate the width of three standard 60 inch wide rolls of film. Approximately 1000 pistons will be employed, with each row containing 20–30 pistons having an extension of up to 6 inches. It is estimated that production will occur at about 2 inches of surface speed per second, with a single run consuming 3,300 meters of film divided among 6 rolls, 215,000 meters of warp yarn, 150,000 meters of fill yarns, and about 105 pounds of adhesive. Preferably, each of the thread applicators are capable of laying down more than one individual yarns at a time, although it is important that the yarns not be tied together transversely such as in the form of a ribbon, in order to allow each individual yarn to follow it on trajectory while being applied to assure a smooth application.

What is claimed is:

1. Method for making a three dimensional flexible laminate, said method comprising the steps of applying a base film layer to a rotating roll having adjacent sectors, deforming said adjacent sectors across the roll to deform successive profile segments of said base film into a three dimensional shape, applying adhesive and reinforcing elements to said base film, and applying a top film layer over said base film layer while on said roll to form a laminate.

2. The method of claim 1 wherein said film is heated while being deformed.

3. The method of claim 1 wherein heat and pressure are applied to the laminate to set the adhesive.

4. The method of claim 3 wherein the base film is air pervious and the top film layer is impervious, and wherein pressure is applied by drawing a vacuum through the pervious base film layer.

5. The method of claim 1 wherein the step of applying a top film layer comprises the step of first deforming the top film layer to match the profile segments of the base film layer.

6. The method of claim 5 wherein said top film layer is deformed on a second rotating roll.

7. The method of claim 1 wherein said reinforcing elements comprise continuous yarns.

8. The method of claim 1 wherein said three dimensional flexible laminate is a sail.

9. The method of claim 8 wherein said sail is triangular in shape and has corners.

10. The method of claim 9 wherein said reinforcing elements comprise continuous yarns extending between corners of the sail.

11. The method of claim 1 wherein said deformed successive profile segments of said base film are maintained on said roll until said laminate is removed from said roll.

12. The method of claim 1 wherein a vacuum is maintained on said base film layer to temporarily adhere said layer to said roll.

13. The method of continuously making a three dimensional sail, said method comprising the steps of applying a base film layer to a rotating roll having an outer surface, continuously deforming said surface and said film in contiguous sectors across said roll to obtain a curved profile in said base film, applying reinforcing elements and adhesive to said base film while being maintained in said curved profile, providing a top film layer having a shape matching the curved profile, and then laminating said top film layer to said base film layer.

* * * * *